US005131328A

United States Patent [19]

Chan

[11] Patent Number: 5,131,328

[45] Date of Patent: Jul. 21, 1992

[54] SAFETY AND ARMING SYSTEM FOR TUBE LAUNCHED PROJECTILE

[75] Inventor: Steve N. Chan, Adelphi, Md.

[73] Assignee: The United States of America as represented by the Secretary of the Navy, Washington, D.C.

[21] Appl. No.: 807,020

[22] Filed: Dec. 13, 1991

[51] Int. Cl.[5] ..... F42C 15/24; F42C 15/31; F42C 15/34; F42C 15/40

[52] U.S. Cl. ..... 102/229; 102/249; 102/254; 102/263

[58] Field of Search ..... 102/223, 228, 229, 230, 102/247–249, 251, 254, 263, 206

[56] References Cited

U.S. PATENT DOCUMENTS 3,724,385 4/1973 Beatty et al. ..... 102/229
4,407,201 10/1983 Jensen ..... 102/248
4,716,830 1/1988 Davis et al. ..... 102/248
4,815,381 3/1989 Bullard ..... 102/247
4,953,475 9/1990 Monach et al. ..... 102/229

*Primary Examiner*—David H. Brown
*Attorney, Agent, or Firm*—Kenneth E. Walden; Jacob Shuster

[57] ABSTRACT

An inertia element within a projectile is displaced to a retracted position by acceleration of the projectile during launch to unblock displacement of a slider to an armed position in response to subsequent pressurization of a projectile flight motor. Safe separation timers are thereby enabled in response to proper launch to delay pressurization of the flight motor and powering of an explosive firing circuit through switches actuated by said displacement of the slider from a safe position to the armed position. The slider is held in its safe position by an electrically grounded shear wire that is ruptured in response to slider displacement thereby removing a power disabling shunt connection to the firing circuit.

24 Claims, 4 Drawing Sheets

SAFETY AND ARMING SYSTEM FOR TUBE LAUNCHED PROJECTILE

BACKGROUND OF THE INVENTION

This invention relates to safety and arming of self-propelled missiles or the like to insure safe separation of the missile from its launcher before detonation of the missile warhead.

Generally, safety and arming systems prevent the arming of warheads carried by projectiles until an acceptable set of conditions has been achieved. The utilization of non-interrupted explosive train control is often associated with such systems involving relatively complex electronics and expensive implementation and testing procedures.

An example of a safety and arming system for a warhead carried by a drive motor propelled missile is disclosed in U.S. Pat. No. 4,145,971 to Graham et al., featuring digital and analog timers activated by a combination of conditions involving launch acceleration and projectile spin to control firing of a piston slider type of interrupter locked in a safe position by a shear wire which is ruptured by a piston motor to allow the slider to move to an armed position aligning a detonator carried by the slider with a warhead explosive train. Such shear wire safety feature is removed by stored energy, while the timers are energized by a missile battery experiencing set back and projectile spin.

Other comparable prior art systems include interrupters that are spring biased, require achievement of plural conditions within a common timing window, and utilize coded signals from pneumatic, optical and electrical sources. It is therefore an important object of the present invention to provide a safety and arming system that is less complex, more reliable and less costly to implement and test as compared to prior functionally comparable systems.

SUMMARY OF THE INVENTION

In accordance with the present invention a slider of a safety and arming mechanism is displaced to an armed position in response to proper pressurization of the associated missile flight motor. The slider is displaced from a safe position in which it is mechanically held by a shear wire which also functions to disable a firing circuit by electrical shunt grounding. Such safety feature is removed in response to rupture of the shear wire by displacement of the slider enabling detonation of one or more explosive charges associated with one or more warhead assemblies.

The firing circuit is powered by the missile battery under joint control of a pair of safe separation timers respectively and independently activated in response to proper pressurization of the flight motor and proper launch acceleration of the projectile. Firing of the flight motor is controlled through only one of the timers in response to proper launch by means of an acceleration responsive inertia element displaced parallel to the direction of launch against a preloaded spring bias from a position in which it blocks improper displacement of the slider to the armed position. When the inertia element is fully retracted from its slider blocking position, it closes a spring latched power switch connecting the missile battery to said one of the timers for activation thereof to establish a timing window for said firing of the flight motor. The other timer is then enabled through an interfacing gate to control the delayed powering of the firing circuit activated through a battery connected switch device in response to said displacement of the slider to the armed position under proper pressurization of the flight motor.

BRIEF DESCRIPTION OF THE DRAWING FIGURES

Other objects, advantages and novel features of the invention will become apparent from the following detailed description of the invention when considered in conjunction with the accompanying drawing wherein.

Figure 4:
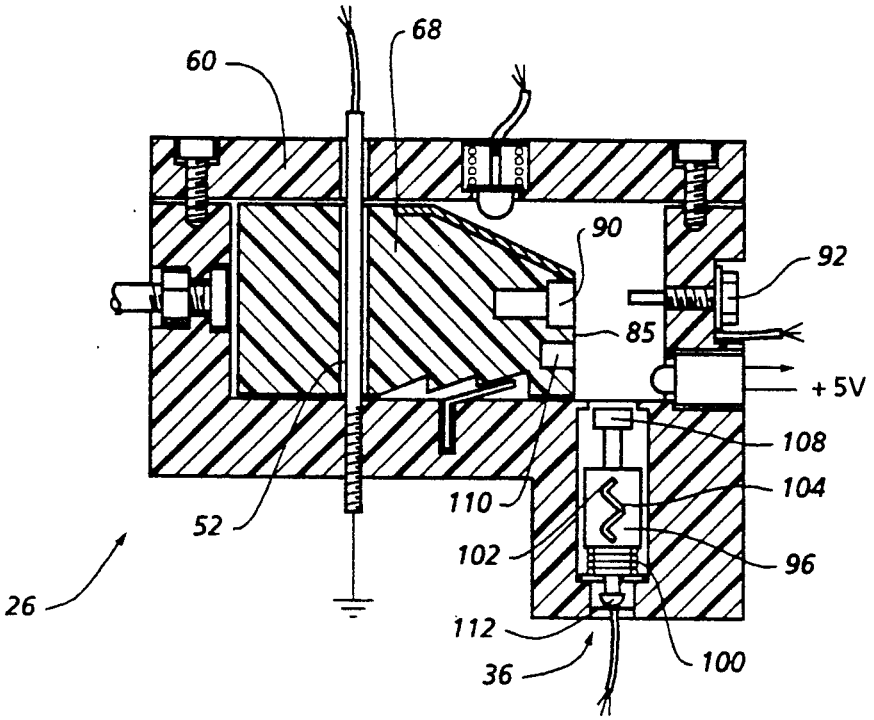
FIG. 4 is a side section view similar to FIG. 2 showing the safety arming mechanism in another operational stage.
Figure 6:
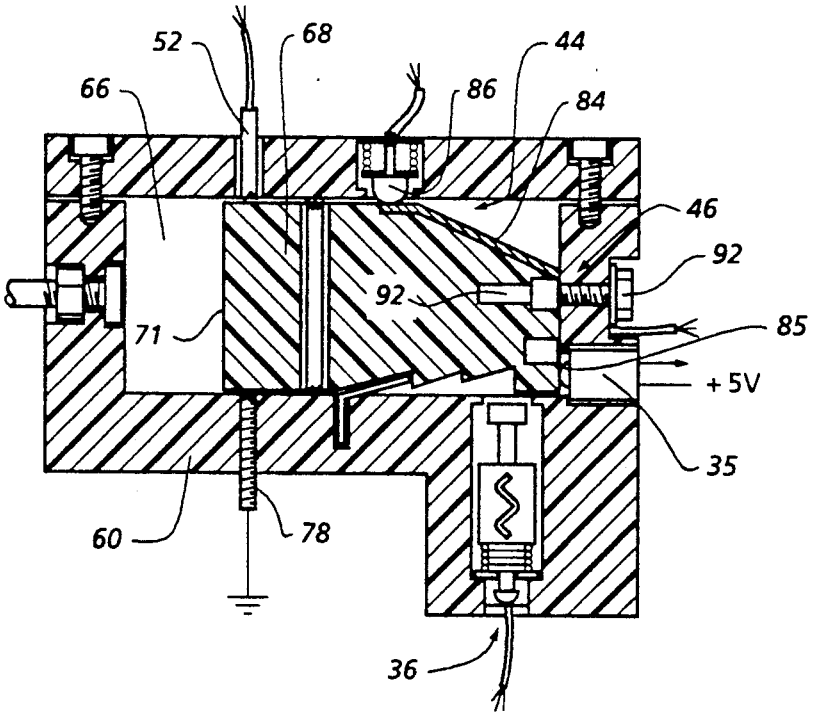
Figure 7:
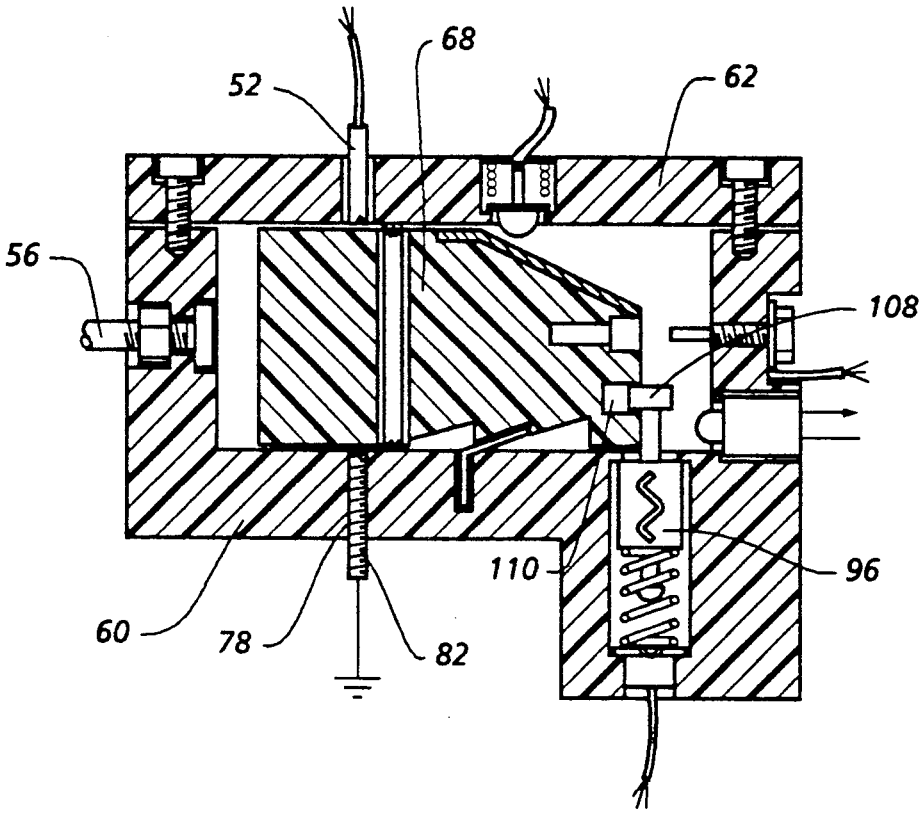

FIG..5 is a partial section view taken substantially through a plane indicated by section line 5—5 in FIG. 4; and FIG. 6 and 7 are side section views similar to FIG. 4 showing the safety arming mechanism in yet other operational stages thereof.

DETAILED DESCRIPTION OF THE PREFERRED EMBODIMENT

Figure 1:
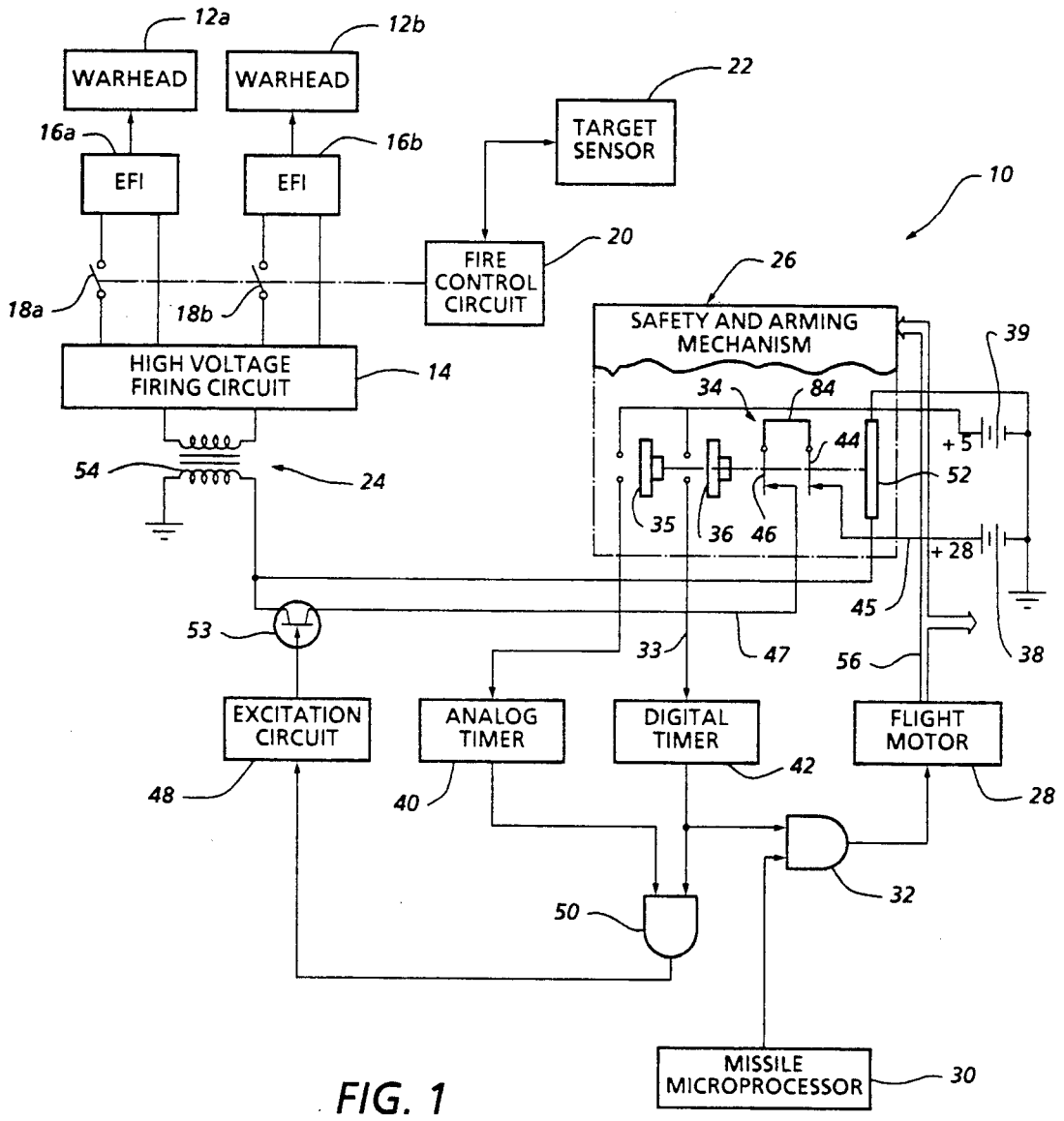
FIG. 1 is a schematic block and circuit diagram of a system in accordance with one embodiment of the invention.

Referring now to the drawing in detail, FIG. 1 schematically depicts a system generally referred to by reference numeral 10 associated with a projectile such as a munition missile having warhead assemblies 12*a* and 12*b* adapted to be detonated under a certain combination of conditions including for example a safe separation distance of the missile from its launching tube and launching personnel. The missile also has associated therewith in the illustrated embodiment a high voltage firing circuit 14 for sequential detonation of two explosive charges in the warhead assemblies through exploding foil initiators 16*a* and 16*b* upon closing of trigger switches 18*a* and 18*b* under control of a fire control circuit 20 in response to detection of a valid target by a target sensor 22 in accordance with already known firing techniques.

The firing circuit 14 is powered through a transformer 24 under control of a safety and arming mechanism 26 in accordance with the present invention to correlate warhead detonation with launch and propulsion of the missile thereafter by its own flight motor 28 of a fluid pressure operated type. Operation of the flight motor is effected in response to a motor firing pulse signal from a microprocessor 30 associated with the missile through an interfacing AND gate 32 as diagrammed in FIG. 1. The safety and arming mechanism 26 controls actuation of normally open switch devices 34, 35 and 36 associated therewith, electrically connected to source of voltage 38 such as +28 volt missile battery and a source of voltage 39. The switch device 34 thereby connects voltage source 38 to a normally open dynamic switch device 53, such as a N-channel MOSFET, while switch devices 35 and 36 respectively trigger operation of safe separation timers 40 and 42. The timer 42, is of the digital type connected to one of the input terminals of the aforementioned AND gate 32. Thus, upon closing of switch device 36, connected by conductor 33 to timer 42, operation of the flight motor 28 under control of microprocessor 30 is enabled after launch of the missile for a short interval of time deemed necessary to effect subsequent propulsion of the missile toward the target. The switch device 34 is of the single pole-double throw type including switches 44 and 46 sequentially actuated by the safety and arming mechanism 26 to initially connect the voltage source 38 through conductor 45 to switch 44 and then through switch 46 and conductor 47 to the dynamic switch 53. The switch device 35 is actuated by mechanism 26 to connect the lower voltage source 39 to analog timer 40 for delaying generation of a dynamic signal by an excitation circuit 48 to which the timer 40 is connected by an interfacing AND gate 50. The output of excitation circuit 48 is applied to the control gate of switch 53 through which operation of transformer 24 controls powering of the firing circuit 14. One input terminal of the AND gate 50 is connected to the output of timer 42 as diagrammed in FIG. 1 in order to enable the excitation circuit 48 only after both timers 40 and 42 time out to establish the safe separation delay for the warheads.

In addition to the foregoing functions of the switch devices 34, 35 and 36 in initiating delayed operation of the excitation circuit 48 and flight motor 28, the safety and arming mechanism 26 functions to limit operation of the transformer 24 before the flight motor 28 is activated. In the safety condition of mechanism 26 during missile launch and prior to operation of flight motor 28, the transformer 24 is protectively disabled by electrical shunting through a grounded shear wire element 52 connected to the primary coil 54 of the transformer. When the mechanism 26 is shifted to its armed condition by a fluid pressure signal in line 56 from the flight motor 28, the shear wire element 52 is ruptured to remove the ground connection established therethrough. Operation of the transformer is thereby enabled to power the firing circuit.

Figure 2:
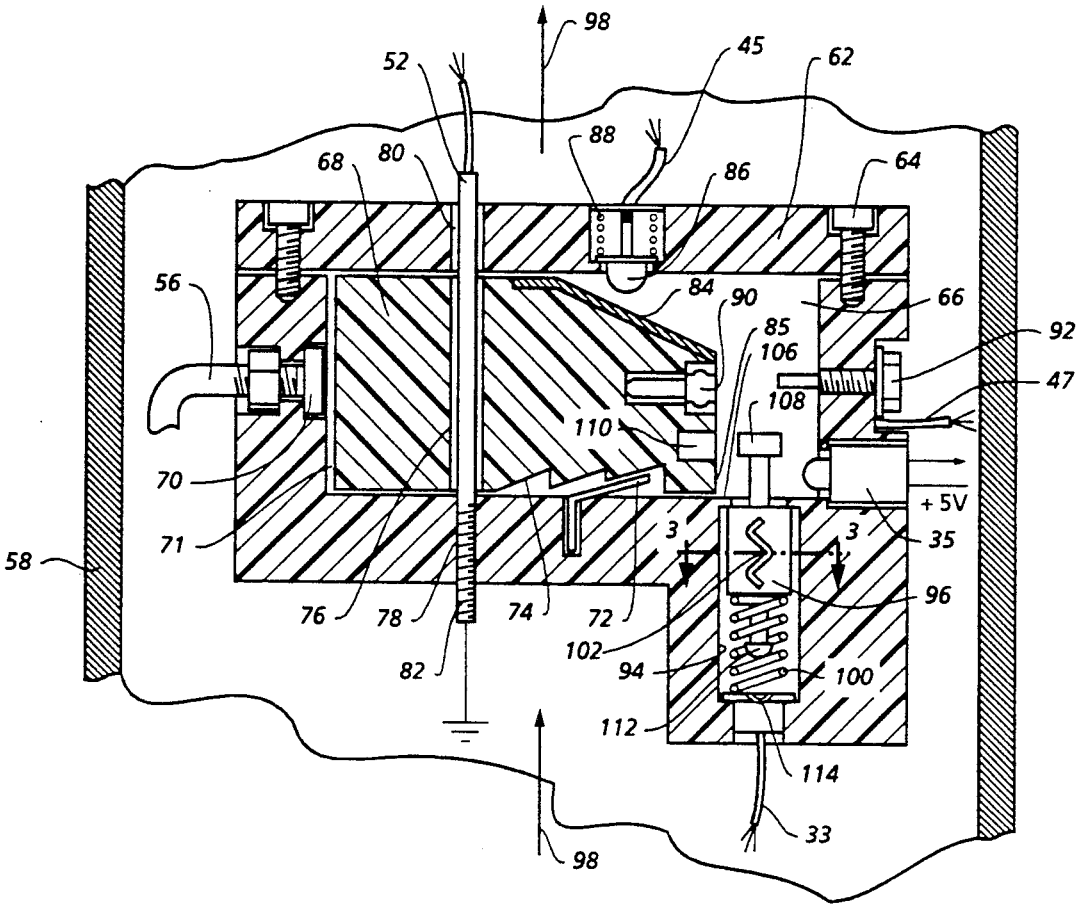
FIG. 2 is a side section view through a portion of the tube launched projectile housing the safety arming mechanism schematically depicted in FIG. 1, assembled in a safety condition.

FIG. 2 illustrates the safety arming mechanism 26 assembled in its safety condition within the tubular casing 58 of its missile or projectile. The mechanism 26 is enclosed within an electrically non-conductive housing 60 fixed to the missile casing 58. The housing has an electrically non-conductive cover 62 secured thereto by screw fasteners 64 to enclose a chamber 66 within which a piston actuator in the form of a slider 68 is movably mounted for displacement from the safety position shown in FIG. 2 to the armed position shown in FIG. 6. The slider 68 is displaced by the pressurized fluid in the activated flight motor conducted to the chamber 66 through port 70 adjacent to an axial end face 71 on the left side of the slider as viewed in FIGS. 2, 4, 6 and 7. Displacement of the slider is limited to one direction along its axis by a locking leaf spring 72 engageable with a saw-toothed notch formation 74 on the slider. A bore 76 is formed in the slider extending therethrough in a direction transverse to its displacement axis. In the safety position of the slider as shown in FIG. 2, the bore 76 is aligned between a threaded bore 78 in the housing 60 and an opening 80 in its cover 62 so as to accommodate positioning of the shear wire element 52 within slider bore 76. The element 52 is provided with an anchoring portion 82 through which it is threadedly fixed to the housing within its bore 78 and electrically grounded. The end of the shear wire element 52 opposite the threaded anchoring portion 82 projects through opening 80 in the housing cover 62 for electrical connection to the aforementioned primary coil 54 of the transformer 24.

The body of the slider 68, which is made of an electrically non-conductive material, actuates the switch device 35 and the switches 44 and 46 of the switch device 34 aforementioned. The switch device 34 in the embodiment illustrated in FIG. 2 includes an electrically conductive contact pad 84 fixed to a camming portion of the slider body axially spaced from bore 76 and extending at an incline toward end face 85 opposite end face 71. A switch contact element 86 is displaceably mounted in the housing cover 62 under the bias of a spring 88 to form with the contact pad 84 the normally open switch 44 as diagrammed FIG. 1. An electrically conductive receptacle 90 is embedded in the body of slider 68 for exposure at its end face 85 to a connector contact 92 threadedly mounted in the housing 60 in alignment with receptacle 90. The connector contact 92 and receptacle 90 form the switch 46 of the switch device 34, as diagrammed in FIG. 1, to which switch 53 is connected through conductor 47. Thus, displacement of slider 68 from its safe position shown in FIG. 2 to the armed position shown in FIG. 6 in response to proper flight motor pressurization initially closes switch 44 by engagement of pad 84 with contact 86 connected by conductor 45 to the voltage source 38. The switch 44 is accordingly held closed against the bias of spring 88 as switch 46 is closed by reception of connector contact element 92 within receptacle 90 electrically connected to switch 44 through pad 84. As shown in FIG. 6, the contact 86 when engaged projects from the housing cover 62 to visually indicate that the slider 68 is in the armed position. In such armed position, the end face 85 of slider 68 engages the switch device 35 mounted in the housing 60. The slider 68 thereby actuates the switch device 35 to connect voltage source 39 to the analog timer 40.

Figure 3:
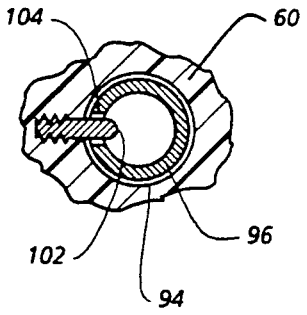
FIG. 3 is a partial section view taken substantially through a plane indicated by section line 3—3 in FIG. 2.

The housing 60 also slidably mounts within a cylindrical bore 94 a cylindrical element 96 that is displaceable along an axis perpendicular to the slider displacement axis and parallel to the direction of launch as indicated by arrows 98 in FIG. 2. Thus, in response to launch of the missile casing 58 in the direction of arrows 98, the element 96 is displaced by inertia against the bias of a setback spring 100 to a retracted position within bore 94 as shown in FIG. 4. Such displacement of inertia element 96 is regulated by a pin 102 fixed to the housing 60 and projecting through a zig-zag track 104 formed in the element as more clearly seen in FIG. 3. Since the axial displacement of the slider 68 is perpendicular to that of element 96, slider displacement is not effected by inertia forces during launch.

Figure 5:
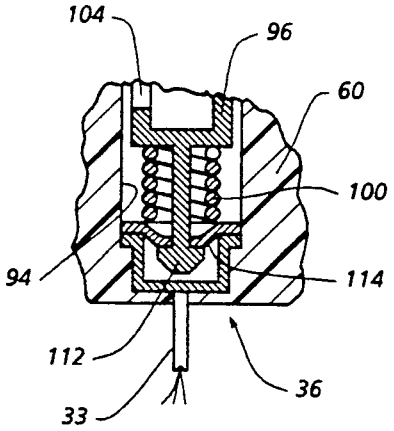

In its normal position under the bias of spring 100, the inertia element 96 at its upper axial end abuts a retention flange 106 as shown in FIG. 2. A stop formation 108 projects from the element 96 into chamber 66 and in its normal blocking position as shown is in spaced alignment with a stop receiving recess 110 formed in the axial end face 85 of the slider. Full displacement of the slider to the armed position, shown in FIG. 6, is thereby blocked as shown in FIG. 7. When the acceleration responsive inertia element 96 is displaced relative to the housing 60 to its retracted position as shown in FIGS. 4 and 5, a switch contact element 112 extending therefrom is projected through a lock spring 114 to retain the inertia element 96 in its retracted position under the bias of spring 100. The lock spring 114 when engaged by contact element 112 closes the normally open switch device 36 formed thereby, to which the timer 42 is electrically connected by conductor 33 as diagrammed in FIG. 1.

Operation of the fully assembled safety and arming mechanism 26 of system 10 may now be summarized by reference to the different operational stages respectively depicted in FIGS. 2, 4, 6 and 7. When switch actuating slider 68 is in its safe position, the protective shear wire element 52 acts as a mechanical lock to hold the slider in such safety position, as shown in FIG. 2, with the axial end portions of the element 52 visibly exposed externally of the housing 60 to indicate proper assembly. The shear wire element 52 also acts as an interrupter to prevent the flow of electrical energy through the transformer 24 and firing circuit 14 to the initiators 16 because of its electrical grounding function. Further, by selection of its material and size the shear wire element 52 is designed to resist rupture during logistic handling yet allow shearing in response to slider displacement by application of flight motor pressure to housing chamber 66 through port 70. Also, improper assembly of the components of mechanism 26 will be indicated if insertion of the shear wire 52 is blocked because of misalignment of parts.

During launch of the missile in the direction of arrows 98, the inertia force produced by acceleration of mechanism 26 in such direction causes the inertia element 96 to be translated in the opposite directional sense to compress the setback spring 100 as shown in FIG. 4. The design of the element 96, the preloading of spring 100 and its spring rate are such as to prevent translation of element 96 to its fully retracted position as a result of rough handling. Full translation of the element 96, on the other hand, is permitted as a result of the acceleration-time profile established by proper missile launch. When such full translation of element 96 occurs, it is latched in the fully retracted position closing switch device 36 to activate the flight motor "window" timer 42 by means of which a delay period is established to obtain a safe separation distance from the launcher before the flight motor 28 is activated by a motor fire signal from the missile microprocessor 30 interfaced with the motor through gate 32. The timer 42 at the end of the delay period is operative through the interfacing gate 32 to limit the duration of the motor activating signal delivered, to 200 milliseconds for example, thereby insuring that the flight motor plume will not create a hazard to launch personnel and to hold the flight motor disarmed in case of abnormal missile operation.

When the flight motor is activated, the pressurized gas therein is conducted by the high pressure tubing line 56 to the port 70 of the housing chamber 66. The pressure force thereby generated and exerted on the end face 71 of the slider 68 causes displacement thereof toward the armed position shown in FIG. 6, shearing the wire element 52. The grounding shunt action of the wire element 52 is thereby interrupted to enable supply of energy from the missile battery voltage source 38 to the high voltage transformer 24 through switch devices 34 and 53 as hereinbefore described. At the same time, the switch device 34 is operated by the camming action of the slider on contact 86 and reception of contact 92 within receptacle 90 in the slider to activate the timer 40. Arming of the warhead assemblies 12 is thereby delayed for a predetermined count-down period before a transformer excitation signal is generated by circuit 48 causing oscillation of switch device 53 and application therethrough of a pulsating voltage from battery 38 to activate the transformer. In view of the interconnection between the interfacing gates 32 and 50 as diagrammed in FIG. 1, completion of time counts is required for both timers 42 and 40 before transformer activation occurs. Thus, early time-out is prevented to insure safe separation and avoid inadvertent detonation.

In the event that the slider 68 is prematurely displaced by pressurization of the flight motor 28 before launch, the inertia element 96 will not be retracted so that the lock formation 108 thereon will be captivated in the recess 110 of the slider and interlock therewith, as shown in FIG. 7, to permanently prevent full displacement of the slider to the armed position.

Numerous other modifications and variations of the present invention are possible in light of the foregoing teachings. It is therefore to be understood that within the scope of the appended claims the invention may be practiced otherwise than as specifically described.

I claim:

1. In combination with a projectile having a firing circuit and motor means responsive to activation thereof for propulsion of the projectile, a safety and arming system comprising: an actuator displaceable between safe and armed positions, acceleration controlled means for blocking inadvertent displacement of the actuator to the armed position, protective means for holding the actuator in the safe position during launching of the projectile while maintaining the firing circuit deactivated and control means responsive to displacement of the actuator to the armed position by said activation of the motor means for delayed activation of the firing circuit.

2. The system as defined in claim 1 wherein the control means includes a pair of contacts mounted in the projectile in fixedly spaced relation to each other, a source of voltage connected to one of the contacts, safe separation timer means operatively interconnected between the acceleration controlled means and the motor means for delaying said activation of the motor means and conductor means mounted on the actuator for electrically interconnecting said contacts in series in response to said displacement of the actuator to the armed position.

3. The system as defined in claim 1 including transformer means grounded by the protective means for powering the firing circuit in response to said displacement of the actuator by the motor means.

4. The system as defined in claim 3 wherein said protective means includes an electrically grounded shear wire connected to the transformer means and extending through a bore formed in the actuator directionally transverse to said displacement thereof.

5. The system as defined in claim 1 wherein the acceleration controlled means includes inertia means mounted in the projectile for displacement relative thereto from a blocking position preventing said inadvertent displacement of the actuator to the armed position, safe separation timer means connected to the motor means for limiting said activation thereof to a predetermined duration and latching switch means closed in response to said displacement of the inertia means to a retracted position for triggering operation of the timer means upon proper acceleration of the projectile during said launching thereof.

6. The system as defined in claim 5 wherein the control means includes a pair of spaced contacts fixedly mounted in the projectile, a source of voltage connected to one of the contacts, interfacing means interconnecting the timer means and the motor means for delaying said activation of the motor means and conductor means mounted on the actuator for electrically interconnecting said contacts in series in response to said displacement of the actuator to the armed position.

7. The system as defined in claim 6 wherein the actuator comprises a fluid pressure operated slider displaceably mounted within a fluid pressure chamber formed in the projectile to which the motor means is connected.

8. The system as defined in claim 1 wherein said protective means comprises an electrically conductive element connected to the firing circuit and extending through the actuator in the safe position thereof and means anchoring the conductive element within the projectile for rupture in response to said displacement of the actuator from the safe position by the motor means.

9. The system as defined in claim 8 wherein said electrically conductive element is a grounded shear wire operatively connected to the firing circuit, said actuator having a bore formed therein through which the shear wire extends directionally transverse to said displacement of the actuator from the safe position.

10. The system as defined in claim 8 wherein the anchoring means includes a housing fixed to the projectile within which the actuator and the acceleration controlled means are guidingly mounted.

11. The system as defined in claim 10 wherein the acceleration controlled means includes inertia means mounted by the housing for displacement relative thereto from a blocking position preventing said inadvertent displacement of the actuator to the armed position, safe separation timer means connected to the motor means for limiting said activation thereof to a predetermined duration and latching switch means closed in response to said displacement of the inertia means to a retracted position for triggering operation of the timer means upon proper acceleration of the projectile during said launching thereof.

12. The system as defined in claim 11 wherein the control means includes a pair of spaced contacts mounted on the housing, a source of voltage connected to one of the contacts, interfacing means interconnecting the timer means and the motor means for delaying said activation of the motor means and conductor means mounted on the actuator for electrically interconnecting said contacts in series in response to said displacement of the actuator to the armed position.

13. The system as defined in claim 11 including transformer means grounded by the conductive element for enabling said delayed activation of the firing circuit in response to said rupture of the conductive element and excitation means operatively connected to the control means and the timer means for controlling supply of voltage from said source to the transformer means to power the firing circuit.

14. The system as defined in claim 13 wherein said timer means includes an analog timer connected by the interfacing means to the excitation means and a digital timer connected between the latching switch means and the motor means through the interfacing means.

15. The system as defined in claim 14 wherein the actuator comprises a fluid pressure operated slider displaceably mounted within a fluid pressure chamber of the housing to which the motor means is connected.

16. The system as defined in claim 15 wherein said conductive element of the protective means is an electrically grounded shear wire connected to the transformer means and extending through a bore formed in the slider directionally transverse to said displacement thereof.

17. In a safety and arming system for a projectile adapted to be launched toward a target, an actuator, fluid pressure operated means for displacement of the actuator within the projectile between safe and armed positions, safe separation means for enabling delayed operation of the fluid pressure operated means during launching of the projectile, protective means for holding the actuator in the safe position thereof during said launching of the projectile and acceleration controlled means for blocking inadvertent displacement of the actuator to the armed position thereof, the acceleration controlled means including inertia means mounted in the projectile for displacement relative thereto from a blocking position preventing said inadvertent displacement of the actuator to the armed position, and latching switch means closed in response to said displacement of the inertia means to a retracted position for triggering operation of the safe separation means upon proper acceleration of the projectile during said launching thereof.

18. The system as defined in claim 17 including a pair of contacts mounted in the projectile in fixedly spaced relation to each other, a source of voltage connected to one of the contacts and conductor means mounted on the actuator for electrically interconnecting said contacts in series in response to said displacement of the actuator to the armed position.

19. In a safety and arming system for a projectile adapted to be launched in a predetermined direction, having a firing circuit and an actuator displaceable with the projectile transverse to said predetermined direction between safe and armed positions and protective means for holding the actuator in the safe position thereof including: an electrical grounding element, means operatively connecting the grounding element to the firing circuit for disabling operation thereof and holding means mounted by the actuator through which the grounding element extends for enabling rupture thereof in response to displacement of the actuator from the safe position.

20. The system as defined in claim 19 wherein said holding means includes a bore formed in the actuator substantially parallel to said predetermined direction in which the projectile is launched and means anchoring the grounding element to the projectile while extending through said bore in the actuator.

21. The system as defined in claim 20 including a source of voltage and switch means operatively interconnecting the source and the firing circuit for energization thereof in response to said displacement of the actuator to the armed position.

22. The system as defined in claim 20 including stop means for blocking said displacement of the actuator to the armed position and inertia means responsive acceleration of the projectile in said predetermined direction for retraction of the stop means to allow said displacement of the actuator to the armed position.

23. The system as defined in claim 20 including a voltage and switch means operatively interconnecting the source and the firing circuit for energization thereof in response to said rupture of the grounding element.

24. The system as defined in claim 23 including retractable stop means for blocking said displacement of the actuator to the armed position and inertia means responsive acceleration of the projectile in said predetermined direction for retraction of the stop means to allow said displacement of the actuator to the armed position.

* * * * *